US005738112A

United States Patent [19]

Brod

[11] Patent Number: 5,738,112

[45] Date of Patent: Apr. 14, 1998

[54] TOILET SAFETY DEVICE INCORPORATING RETRACTABLE BELTS

[76] Inventor: Walter V. Brod, 1310 E. 22nd St., Minneapolis, Minn. 55404

[21] Appl. No.: 720,861

[22] Filed: Oct. 2, 1996

[51] Int. Cl.[6] ..... A61B 19/00

[52] U.S. Cl. ..... 128/869; 4/254

[58] Field of Search ..... 297/484, 468, 297/464; 4/254; 128/869, 870, 875, 876; 5/81.1 R, 424

[56] References Cited

U.S. PATENT DOCUMENTS

| | | | |
|---|---|---|---|
| 2,814,336 | 11/1957 | Manhart | 297/468 |
| 4,015,878 | 4/1977 | Perkins | 297/468 |
| 4,819,278 | 4/1989 | Ramos | 4/254 |
| 4,846,527 | 7/1989 | Julien | 297/468 |
| 5,027,446 | 7/1991 | Robertson | 4/254 |
| 5,492,285 | 2/1996 | Hamrick | 128/876 |

*Primary Examiner*—Flemming Saether
*Attorney, Agent, or Firm*—Merchant, Gould, Smith, Edell, Welter, & Schmidt, P.A.

[57] ABSTRACT

The present invention relates to a safety device for mounting on a wall behind a toilet. The safety device includes a housing defining a first opening spaced from a second opening. The housing is preferably mounted on the wall at a location above the toilet. The safety device includes first and second belts retractably mounted within the housing. The first belt has a first coupling structure configured to be coupled with a second coupling structure connected to the second belt. The safety device also includes a third coupling structure fixedly connected to the housing. The third coupling structure is arranged and configured to be selectively coupled with the first coupling structure.

14 Claims, 3 Drawing Sheets

TOILET SAFETY DEVICE INCORPORATING RETRACTABLE BELTS

FIELD OF THE INVENTION

The present invention relates generally to safety devices. More particularly, the present invention relates to safety devices that utilize belts to prevent individuals from falling and sustaining injuries.

BACKGROUND OF THE INVENTION

For people who lack sufficient muscle strength or muscle coordination to maintain a seated posture, the process of using a toilet can be dangerous. For such people, additional support is required to prevent them from falling from the toilet and potentially physically hurting themselves. Typically, such individuals must depend upon another person to provide physical support while they are using the toilet facility.

SUMMARY OF THE INVENTION

The present invention relates to a safety device for mounting on a wall behind a toilet. The safety device includes a housing defining a first opening spaced from a second opening. The housing is preferably mounted on the wall at a location above the toilet. The safety device also includes first and second belts that are retractably mounted within the housing and that can be respectively withdrawn from the housing through the first and second openings. The first and second belts are respectively equipped with first and second coupling structures that are constructed and arranged to be selectively coupled together. The safety device further includes a third coupling structure fixedly connected to the housing. The third coupling structure is constructed and arranged to be selectively coupled with the first coupling structure.

In use, the housing of the safety device is mounted on a wall at a location above a toilet. A person requiring stabilization is then seated on the toilet and the first belt is withdrawn from the housing. The belt is then maneuvered such that the belt passes under the person's arms and across the person's chest. Finally, the first coupling structure is coupled to the third coupling structure that is fixedly connected to the housing. As coupled, the first belt forms a loop that passes across the person's chest and under the person's arms for supporting the person on the toilet.

It will be appreciated that because the third coupling structure is fixedly connected to the housing which is located above and behind the toilet, the third coupling structure cannot be readily reached by the person being supported on the toilet. Consequently, the person is prevented from uncoupling the first coupling structure from the third coupling structure. Such a feature is significant because it prevents the supported person from releasing the security belt and increasing the opportunity for injury. Such a feature is typically suitable for individuals that fail to appreciate the risk of injury associated with releasing the belt.

Alternatively, the safety device can be used by seating a person on the toilet and withdrawing both the first and second belts from the housing. The belts are respectively maneuvered under the person's left and right arms and across the person's chest. The first and second coupling structures associated with the belts are then coupled together such that the belts form a loop passing across the person's chest and under the person's arms for supporting the person on the toilet. With such a configuration, the coupled first and second coupling structures are preferably located at the person's chest. Consequently, when the person is finished using the toilet and no longer requires the support provided by the security belts, the person can reach the first and second coupling structures to uncouple the belts. The two belt configuration is preferred for individuals that have sufficient strength and coordination to personally unfasten the security belts without generating an undue risk of injury.

A variety of additional advantages of the invention will be set forth in part in the description which follows, and in part will be obvious from the description, or may be learned by practice of the invention. The advantages of the invention will be realized and attained by means of the elements and combinations particularly pointed out in the claims. It is to be understood that both the foregoing general description and the following detailed description are exemplary and explanatory only and are not restrictive of the invention as claimed.

BRIEF DESCRIPTION OF THE DRAWINGS

The accompanying drawings, which are incorporated in and constitute a part of this specification, illustrate several embodiments of the invention and together with the description, serve to explain the principles of the invention. A brief description of the drawings is as follows.

DETAILED DESCRIPTION OF THE PREFERRED EMBODIMENT

Reference will now be made in detail to exemplary embodiments of the present invention which are illustrated in the accompanying drawings. Wherever possible, the same reference numbers will be used throughout the drawings to refer to the same or like parts.

Figure 1:
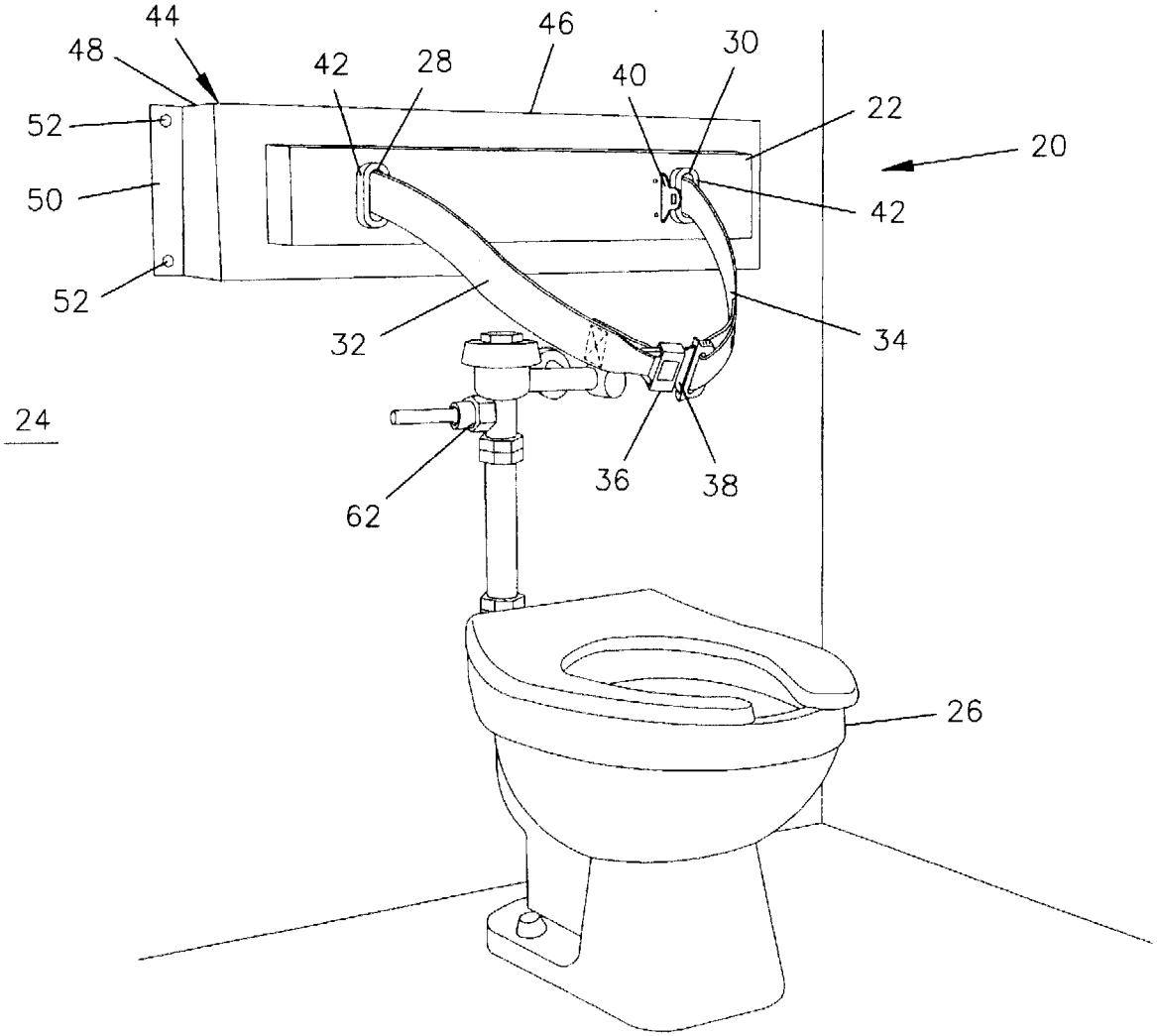
FIG. 1 illustrates a safety device constructed in accordance with the principles of the present invention, the safety device is shown mounted on a wall behind a toilet.

FIG. 1 shows a safety device 20 constructed in accordance with the principles of the present invention. The safety device 20 includes a housing 22 mounted on a wall 24 at a location above and slightly behind a toilet 26. The housing 22 defines a first opening 28 that is spaced from a second opening 30. First and second belts 32 and 34 are retractably mounted in the housing 22. The first belt 32 is constructed and arranged to be selectively withdrawn from the housing 22 and retracted into the housing 22 through the first opening 28. Similarly, the second belt 34 is constructed and arranged to be selectively withdrawn from the housing 22 and retracted into the housing 22 through the second opening 30. A first coupling structure, such as a conventional buckle 36, is connected to the distal end of the first belt 32. A second coupling structure, such as a first tongue member 38 configured to couple with the buckle 36, is connected to the distal end of the second belt 34. A third coupling structure, such as a second tongue member 40 configured to couple with the buckle 36 is fixedly connected to the housing 22 by conventional means such as rivets, bolts or screws.

The housing 24 is preferably rectangular in shape and is preferably constructed of a material such as stainless steel. The first and second openings 28 and 30 of the housing 22 are preferably defined in a front face of the housing 22 and are preferably generally oval in shape. Rubber sealing gaskets 42 extend around the perimeters of the first and second openings 28 and 30. The sealing gaskets function to protect the belts 32 and 34 from excessive wear caused by contact with the edges of the housing 22 defining the first and second openings 28 and 30.

Figure 3:
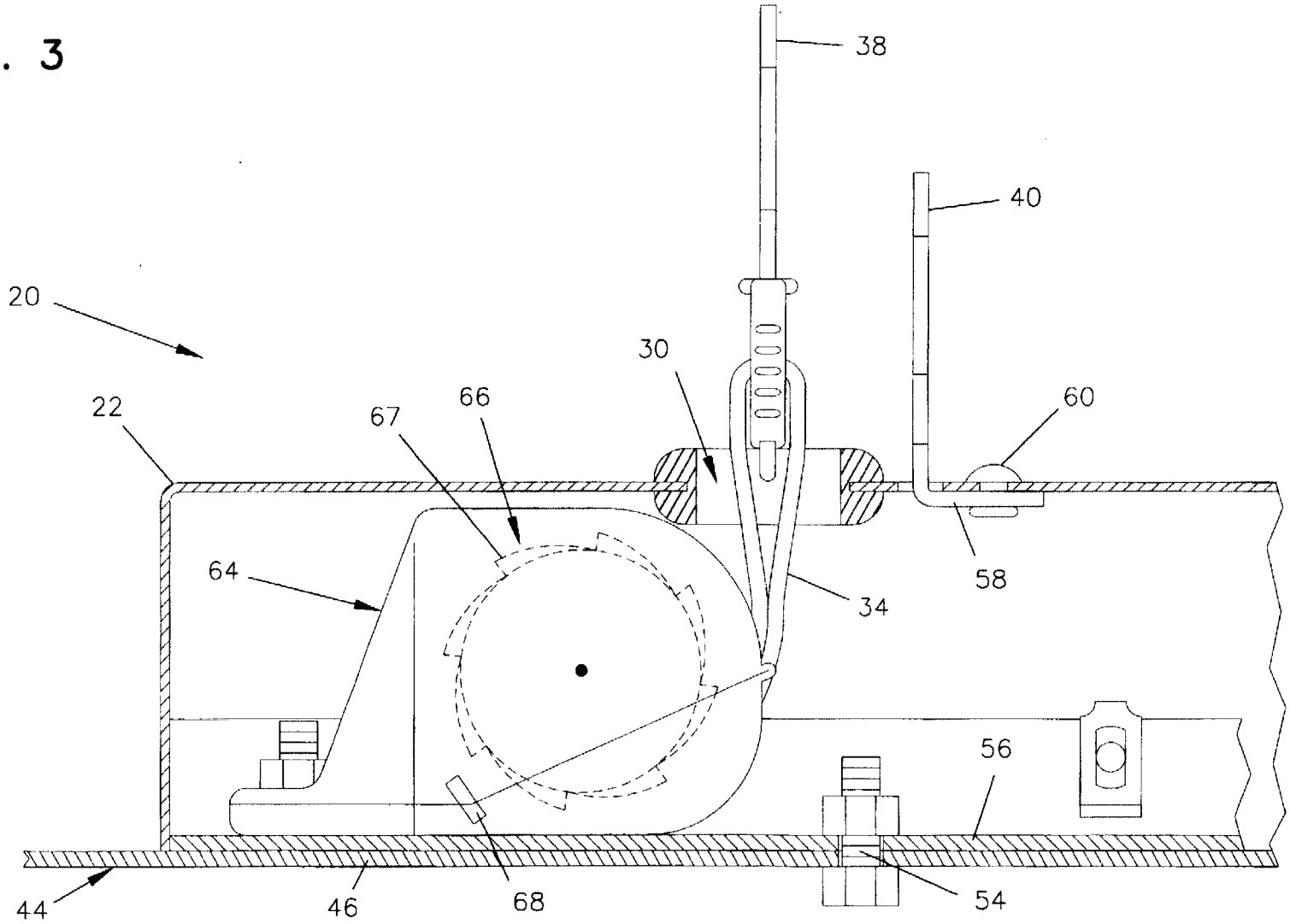
FIG. 3 is a cross sectional view of the safety device of FIG. 1 taken along section line 3—3.

The housing 22 is connected to the wall 24 by a connecting structure such as a bracket member 44 constructed of a material such as stainless steel. The bracket member 44 includes a central portion 46 that is substantially parallel to the wall 24. A pair of leg members 48 extend outward from opposite ends of the central portion 46. The leg members 48 are preferably transversely aligned with respect to the central portion 46 and preferably are configured to extend toward the wall 24. Flange members 50 extend transversely outward from the distal ends of each of the leg members 48. The flange members 50 are preferably aligned substantially parallel to the wall 24. Connecting members, such as toggles or screws 52 extend through the flange members 50 and into the wall 24 such that the bracket member 44 is rigidly mounted on the wall 24. As shown in FIG. 3, the housing 22 is preferably connected to the bracket member 44 by connecting members such as bolts 54 that are secured to the central portion 46 of the bracket member 44 and a rear panel 56 of the housing 22.

The bracket member 44 functions to space the housing 22 a predetermined distance from the wall 24. It is preferred for the bracket member 44 to space the housing 22 a sufficient distance from the wall 24 such that the front face of the housing 22 is aligned approximately in the same vertical plane as the back side of the toilet seat. By spacing the housing 22 from the wall 24, a user of the safety device 22 is prevented from being pushed by the belts 32 and 34 against plumbing 62 located behind the toilet 26. It will be appreciated that in alternative toilet configurations, it may be preferred to mount the housing 22 directly upon the wall 24 without utilizing the bracket member 44.

The second tongue member 40 of the safety device 20 preferably extends transversely outward from the front face of the housing 22. It is preferred for the second tongue member 40 to be located generally adjacent to the second opening 30 of the housing 22. The second tongue 40 has a distal end that is configured to slide axially into a slot defined by the buckle 36. The buckle 36 and the second tongue member 40 are coupled by inserting the tongue member 40 within the slot of the buckle 36. As shown in FIG. 3, the second tongue member 40 extends transversely through an opening defined by the front face of the housing 22. A proximal end 58 is bent at right angles with respect to the main body of the second tongue member 40. The second tongue member 40 is fixedly connected to the housing 22 by connecting members, such as rivets 60, that extend through both the proximal end 58 of the second tongue member 40 and the front face of the housing 22.

The first and second belts 32 and 34 of the safety device 20 are preferably of the type conventionally utilized in the automobile industry as seat belts. Each belt 32 and 34 includes a coupling structure such as the buckle 36 or the first tongue 38, and a take-up mechanism 64 (shown in FIG. 3) mounted within the housing 22. The take-up mechanisms 64 are constructed and arranged to retract the belts 32 and 34 into the housing 22 when there is slack or no tension on the belts 32 and 34. The take-up mechanism for the first belt 32 is preferably mounted within the housing 22 adjacent to the first opening 28 while the take-up mechanism for the second belt 34 is preferably within the housing 22 adjacent to the second opening 30.

Figure 2:
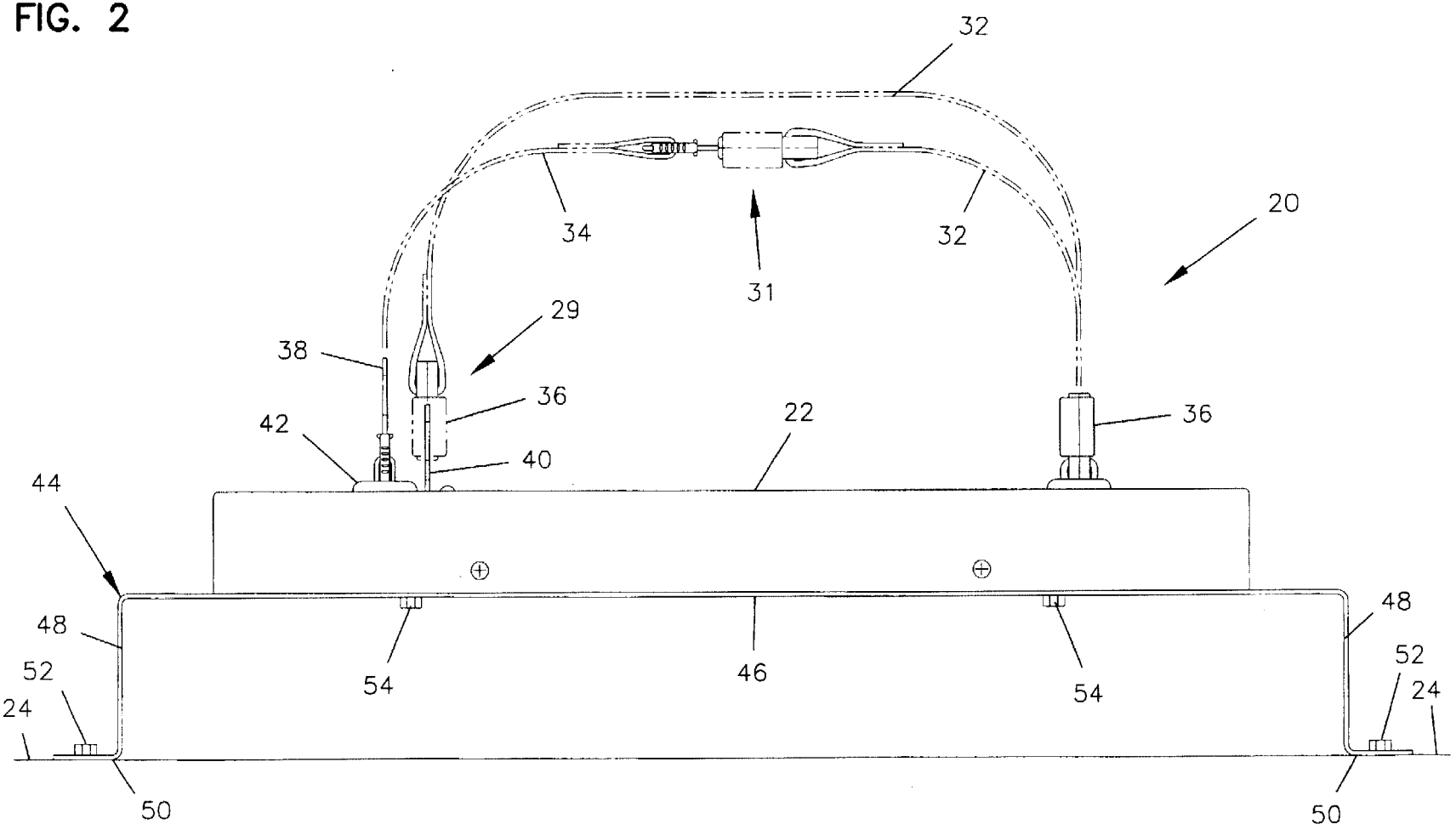
FIG. 2 shows a top view of the safety device of FIG. 1, the figure also illustrates various belt configurations in phantom lines.

FIG. 2 illustrates various belt configurations that can be employed by the safety device 20. For example, when the safety device 20 is not in use, the first and second belts 32 and 34 are retracted within the housing 22 such that only the buckle 36 and the first tongue 38 extend or project outward from the front face of the housing 22. It will be appreciated that the buckle 36 and the first tongue member 38 have dimensions larger than the dimensions of the first and second openings 28 and 30 to prevent the buckle 36 and tongue member 38 from being retracted completely within the housing 22. In this manner, the buckle 36 and the first tongue member 38 can be easily grasped to withdraw the first and second belts 32 and 34 from the housing 22.

FIG. 2 shows the first belt 32 in a first withdrawn configuration 29 in which the buckle 36 is coupled to the second tongue member 40 of the housing 22. In this first configuration 29, the first belt 32 alone forms a loop for securing a person seated on the toilet 26. FIG. 2 also shows an alternative belt configuration 31 in which both the first and second belts 32 and 34 are withdrawn from the housing 22 and the buckle 36 is coupled to the first tongue 38 of the second belt 34. In the second configuration 31, the first and second belts 32 and 34 cooperate to define a loop for securing a person seated upon the toilet 26.

It will be appreciated that seat belt assemblies including belts, coupling structures such as tongues and buckles, and take-up mechanisms are well known in the prior art and are readily available in the market place. For example, a preferred seat belt assembly is distributed by Indiana Mills and Manufacturing Inc. of Carmel, Ind. Furthermore, an exemplary buckle and tongue member are disclosed in U.S. Pat. No. 4,128,924 to Happal et al. which is hereby incorporated by reference.

As described in the previous paragraph, seat belt take-up mechanisms are well known in the art and can be constructed in variety of known configurations. However, generally it is preferred for the take-up mechanisms 64 described herein to each include a spool 66 having at least one integrally formed ratchet gear 67. Coil springs (not shown) are used to bias each spool 66 toward a retracted position. Locking pawls 68 cooperate with each ratchet gear 67 to selectively lock the spools in place to prevent the belts 32 and 34 from being further withdrawn from the housing 22.

When the belts 32 and 34 are fully retracted within the housing, the pawl 68 of each locking mechanism is moved to a disengaged position offset from its corresponding ratchet gear 67. When the belts 32 and 34 are withdrawn from the housing 22, the spools 66 of the take-up mechanisms 64 are caused to rotate and the spring mechanisms associated with the spools 66 are tightened so as to store potential energy for rotating the spools 66 to retract the belts 32 and 34 back into the housing 22. When tension is released from the belts 32 and 34 and slack develops in the belts 32 and 34, the spring mechanisms rotate the spools 66 causing the belts 32 and 34 to be retracted within the housing. Also, when slack develops in the belts 32 and 34, the pawls 68 move to locking positions in which the pawls 68 are oriented to engage the teeth of their corresponding ratchet gears 67 to prevent the belts 32 and 34 from being further withdrawn from the housing 22. In this manner, the take-up mechanisms 64 continuously take up slack and prevent the belts 32 and 34 from being further withdrawn from the housing 22 in order to provide a snug fit about an individual utilizing the safety device 20.

While the spool, ratchet gear and pawl of the take-up mechanism are shown in phantom line in FIG. 3, the belt 34 that is wrapped around the spool 66 is not shown for the purpose of clarity.

In use of the safety device 20, a person requiring the support of the safety device 20 is first seated upon the toilet 26. Next, the first belt 32 is withdrawn from the housing 22 and maneuvered such that the belt 32 passes under the person's arms and across the person's chest. Next, the buckle 36 is coupled to the second tongue 42 that is rigidly connected to the front face of the housing 22. In such a coupled configuration, the belt forms a loop passing across the person's chest and under the person's arms for supporting the person on the toilet. It will be appreciated that the take-up mechanism 64 takes up any slack in the first belt 32 such that the belt pulls snugly across the person's chest. Once the belt is snugly is around the person, the ratchet gear 67 and pawl 68 of the take-up mechanism 64 prevent the belt 32 from being further withdrawn from the housing 22.

Alternatively, both the first and second belts 32 and 34 can be used to provide support to a person on the toilet 26. To use both belts 32 and 34, the person is first seated on the toilet. Next, both the first and second belts 32 and 34 are withdrawn from the housing 22. The belts 32 and 34 are maneuvered under the person's arms and across the person's chest. Finally, the buckle 36 is coupled to the first tongue member 38 such that the first and second belts 32 and 34 cooperate to form a loop passing across the person's chest and under the person's arms for supporting the person on the toilet 26.

Although the present invention is described specifically for use with respect to toilets, it will be appreciated that the invention has alternative applications in a variety of environments. For example, the present invention could be used to provide support in shower facilities or in any other environment in which an individual may require additional physical support.

With regard to the foregoing description, it is to be understood that changes may be made in detail, especially in matters of the construction materials employed and the shape, size, and arrangement of the parts without departing from the scope of the present invention. It is intended that the specification and depicted embodiment be considered exemplary only, with a true scope and spirit of the invention being indicated by the broad meaning of the following claims.

What is claimed is:

1. A safety device for mounting on a wall behind a toilet, the safety device comprising:

a housing defining a first opening spaced from a second opening, the housing including connecting structure for connecting the housing to the wall at a location above the toilet;

a first belt retractably mounted within the housing, the first belt being constructed and arranged to be withdrawn from the housing and retracted into the housing through the first opening;

a first coupling structure connected to the first belt;

a second belt retractably mounted within the housing, the second belt being constructed and arranged to be withdrawn from the housing and retracted into the housing through the second opening;

a second coupling structure connected to the second belt, the second coupling structure being arranged and configured to be selectively coupled with the first coupling structure; and a third coupling structure fixedly connected to the housing, the third coupling structure being arranged and configured to be selectively coupled with the first coupling structure.

2. The safety device of claim 1, wherein the third coupling structure is fixedly connected to the housing at a location adjacent to the second opening of the housing.

3. The safety device of claim 1, wherein the first and third coupling structures comprise tongue members, and the second coupling structure comprises a buckle.

4. The safety device of claim 1, wherein the connection structure comprises a bracket structure constructed and arranged to connect the housing to the wall while concurrently spacing the housing a predetermined distance from the wall.

5. The safety device of claim 4, wherein the bracket structure includes a central portion for connection to the housing, and a pair of leg members extending transversely outward from opposite ends of the central portion for connection to the wall.

6. A method for supporting a person on a toilet by using a safety device mounted on a wall behind the toilet, the safety device including a housing mounted on the wall at a location above the toilet and a belt retractably mounted within the housing, the safety device also including a first coupling structure connected to the belt and a second coupling structure fixedly connected to the housing, the method comprising the steps of:

seating the person on the toilet;

withdrawing the retractable belt from the housing;

maneuvering the belt such that the belt passes under the person's arms and across the person's chest; and coupling the first coupling structure to the second coupling structure which is connected to the housing, wherein the belt forms a loop passing across the person's chest and under the person's arms for supporting the person on the toilet, and wherein the coupled first and second coupling structures are located at a position above and behind the toilet such that the person can not readily uncouple the first and second coupling structures without assistance.

7. A method for supporting a person on a toilet by using a safety device mounted on a wall behind the toilet, the safety device including a housing mounted on the wall at a location above the toilet and first and second belts retractably mounted within the housing, the safety device also including a first coupling structure connected to the first belt and a second coupling structure connected to the second belt, the method comprising the steps of:

seating the person on the toilet;

withdrawing the retractable first and second belts from the housing attached to the wall;

maneuvering the belts such that the belts pass under the person's arms and across the person's chest; and coupling the first coupling structure to the second coupling structure, wherein the belts form a loop passing across the person's chest and under the person's arms for supporting the person on the toilet and the coupled first and second coupling structures are located at the persons chest such that the person can readily uncouple the first and second coupling structures without assistance.

8. A safety device comprising:

a single housing defining a first opening spaced from a second opening;

connecting structure arranged and configured for connecting the housing to a wall;

a first belt retractably mounted within the housing, the first belt being constructed and arranged to be withdrawn from the housing and retracted into the housing through the first opening;

a first coupling structure connected to the first belt;

a second belt retractably mounted within the housing, the second belt being constructed and arranged to be withdrawn from the housing and retracted into the housing through the second opening; and a second coupling structure connected to the second belt, the second coupling structure being arranged and configured to be selectively coupled with the first coupling structure.

9. The safety device of claim 8, further comprising a third coupling structure fixedly connected to the housing, the third coupling structure being arranged and configured to be selectively coupled with the first coupling structure.

10. The safety device of claim 8, wherein the first coupling structure comprises a tongue member, and the second coupling structure comprises a buckle.

11. The safety device of claim 8, wherein the connection structure comprises a bracket structure constructed and arranged to connect the housing to the wall while concurrently spacing the housing a predetermined distance from the wall.

12. The safety device of claim 11, wherein the bracket structure includes a central portion for connection to the housing, and a pair of leg members extending transversely outward from opposite ends of the central portion for connection to the wall.

13. The safety device of claim 8, wherein the housing has an elongated shape and includes a front face in which both the first and second openings are defined.

14. The safety device of claim 8, wherein the housing comprises a substantially rectangular box including a substantially planar front face in which both the first and second openings are defined.

* * * * *